United States Patent [19]

Chae

[11] Patent Number: 4,923,129

[45] Date of Patent: May 8, 1990

[54] GYRATORY ROCK CRUSHER

[76] Inventor: Y. Jin Chae, 520 Main St., Fort Lee, N.J. 07024

[21] Appl. No.: 343,083

[22] Filed: Apr. 25, 1989

[51] Int. Cl.[5] ..... B02C 2/04

[52] U.S. Cl. ..... 241/207; 241/286

[58] Field of Search ..... 241/207, 208, 210, 211, 241/215, 216, 286, 290

[56] References Cited

U.S. PATENT DOCUMENTS

| | | | |
|---|---|---|---|
| 3,140,835 | 7/1964 | Balmer et al. | 241/286 |
| 3,690,573 | 9/1972 | Kueneman et al. | 241/207 |
| 3,759,453 | 9/1973 | Johnson | 241/207 |
| 4,478,373 | 10/1984 | Gieschen | 241/208 |
| 4,697,745 | 10/1987 | Sawant et al. | 241/207 X |

*Primary Examiner*—Timothy V. Eley
*Attorney, Agent, or Firm*—Eugene M. Eckelman

[57] ABSTRACT

A bowl support ring for a gyratory rock crusher has an annular inwardly directed threaded surface extending in an upright direction. A bowl having an outwardly directed threaded surface is engageable with the threaded surface on the bowl support ring for supporting the bowl on the support ring and for rotatably adjusting it to different vertical planes. A locking ring threadedly engaged with the bowl above the support ring is connected to downwardly extending hydraulic cylinders secured to the main frame of the crusher. These cylinders are arranged to apply a hold-down force on the locking ring which in turn provides a hold-down force acting through the threads of the locking ring and bowl to maintain the bowl in a stationary vertical position and also to frictionally lock the threads of the locking ring and bowl together to maintain the bowl in a non-rotatable position. A plurality of retainer pins with adjustable thrust portions maintain the locking ring in proper spaced relation from the support ring.

10 Claims, 3 Drawing Sheets

GYRATORY ROCK CRUSHER

BACKGROUND OF THE INVENTION

This invention relates to a new and useful improvement in rock crushers and in particular relates to an improved gyratory type rock crusher.

The setting of gyratory rock crushers, that is, the gap between the mantle and the bowl liner is often adjusted by way of a threaded connection as shown in U.S. Pat. Nos. 3,140,835, 3,420,457 and 3,690,573. In such designs a threaded locking ring is employed which is hydraulically forced upwardly to lock the bowl to the bowl support to resist crushing forces imposed upon the bowl assembly. This locking ring can be operated by remote control which amounts to a substantial improvement over manual type clamping methods known as the cap screw or duckworth type threaded bolt. Also, hydraulic clamping methods exist which use hydraulic lock posts. Clamping methods such as hydraulic lock posts require top square and thus add height to the crusher. It is apparent that prior hydraulic locking methods require separate equipment such as hoses, fittings, etc. in addition to a plurality of hydraulic jacks for operating the upwardly driving locking means.

SUMMARY OF THE INVENTION

It is a general object of the invention to provide a gyratory crusher of the type that has a threaded bowl and bowl support, such crusher employing improved features contributing to simiplification in structure and improved operation for locking and adjusting the bowl.

In achieving such objective, the present invention provides an improved locking ring and hydraulic clamping arrangement having important advantages. One such advantage is that the invention utilizes hydraulic relief and hold-down means secured to the main frame as the power source for threaded locking ring, thus eliminating the added extra cost for supplying hydraulic jacks. Also, the overall height of the crusher is reduced, and furthermore such structure also results in the simplification of design since hoses and fittings as required in conventional designs are eliminated, thereby reducing installation and maintenance costs.

A more particular object is to provide vertically movable power means arranged to provide a downward clamping force against the threads of a bowl in frictional engagement to maintain the bowl both in a vertically stationary position and a non-rotatable position. This power means accomplishes a hold-down function which imparts large forces to the main frame flange through a bowl support ring. Such forces are sufficient to resist the crushing forces of the crusher. The hold-down means are releasable to allow adjustment or replacement of the bowl liner and also are associated with relief means to allow the bowl assembly to tilt and allow foreign objects to pass through the crusher. Separate powered means are employed to rotate the bowl in the threads for adjustment.

The invention will be better understood and additional objects and advantages will become apparent from the following description taken in connection with the accompanying drawings.

DETAILED DESCRIPTION OF PREFERRED EMBODIMENTS

Figure 1:
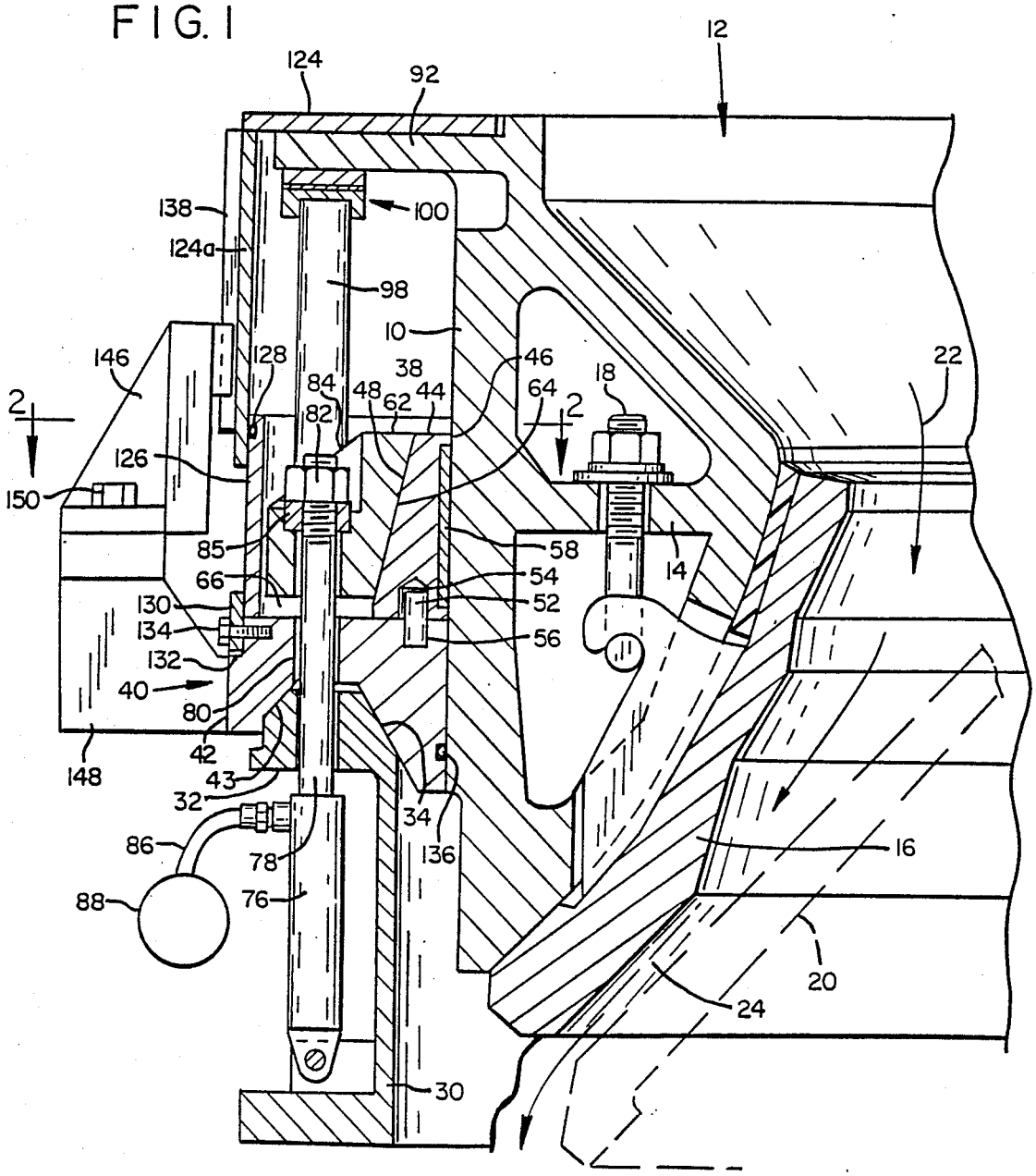
FIG. 1 is a fragmentary vertical cross sectional view taken through the upper main frame and bowl portion of a gyratory rock crusher embodying features of this invention.
Figure 2:
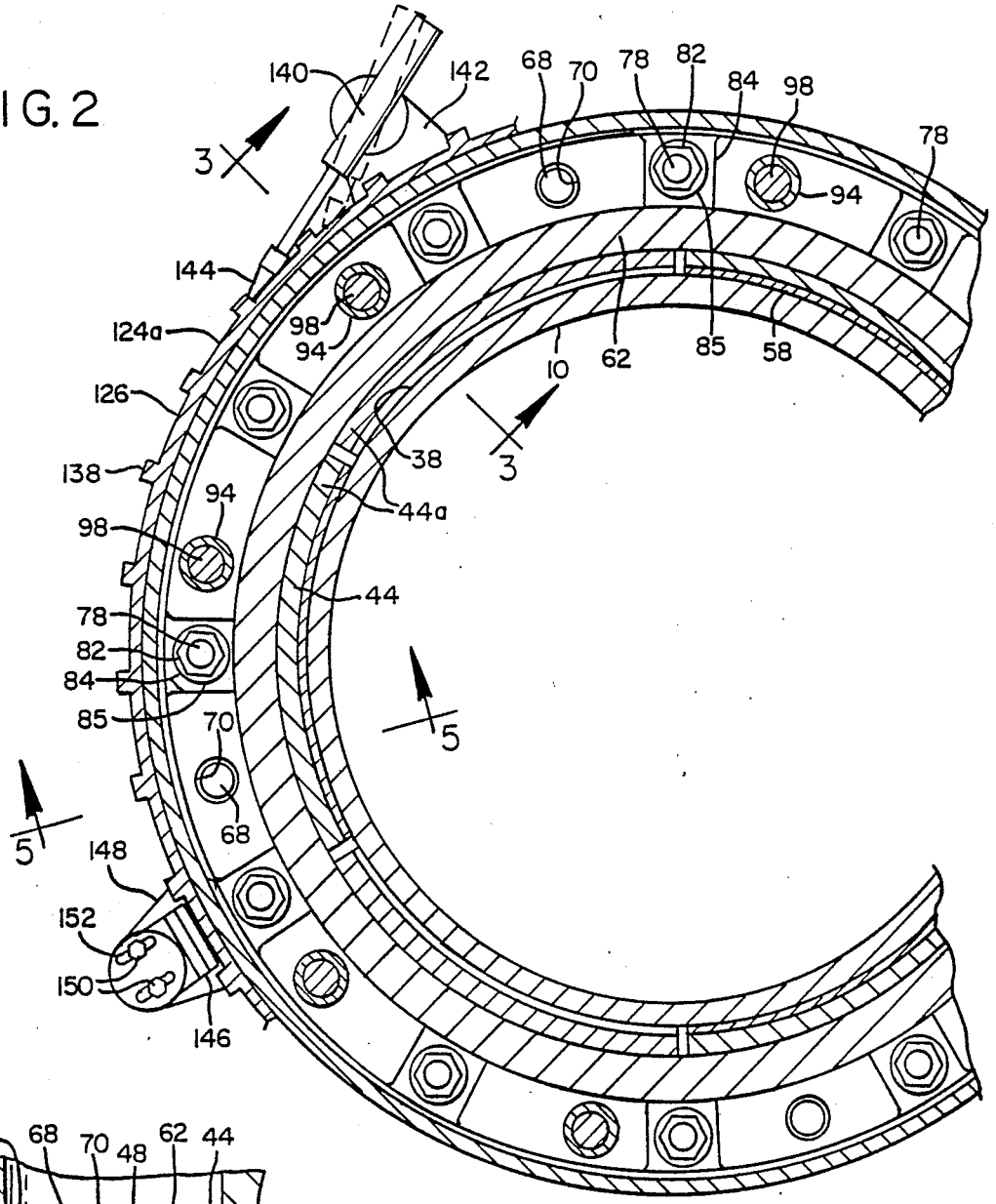
FIG. 2 is a fragmentary horizontal sectional view taken on the line 2—2 of FIG. 1.

With particular reference first to FIGS. 1 and 2, the present invention is concerned with a gyratory rock crusher of the type having an annular bowl 10 with a hopper portion 12 and an inturned flange 14 below its upper edge which supports a liner 16 by means of U-bolts 18 in a conventional manner. Bowl liner 16 is associated with a crusher head portion comprising a mantle 20. Material to be crushed is deposited in the hopper 12 and in the crushing operation such material moves downwardly as designated by arrows 22 through a gap 24 between the bowl liner 16 and mantle 20. The cylindrical outer portion of the bowl 10 has threads 26.

The circumferential frame of the crusher is indicated by the numeral 30 which includes an outwardly turned main frame flange 32 on its upper end. This flange has a frustoconical upper surface 34. The support of the bowl 10 includes a bowl support ring or base member 42 having a bottom recess 44 corresponding substantially in shape to the frustoconical upper surface 34 of the flange 32. The cylindrical inner surface of the bowl support 42 has threads 46 engageable with the threads 26 on the bowl for supporting the bowl for installation and removal and for vertical adjustment, as will be described hereinafter.

A locking ring 48 is disposed above the bowl support ring, and the cylindrical inner surface thereof has threads 50 also engageable with the threads 26 on the bowl. The type of threads used for bowl threads 26 and the bowl support ring and locking ring threads 46 and 50, respectively, comprise threads that have matching tapered surfaces **52*a* and flat surfaces 52*b*, FIG. 3**.

Figure 3:
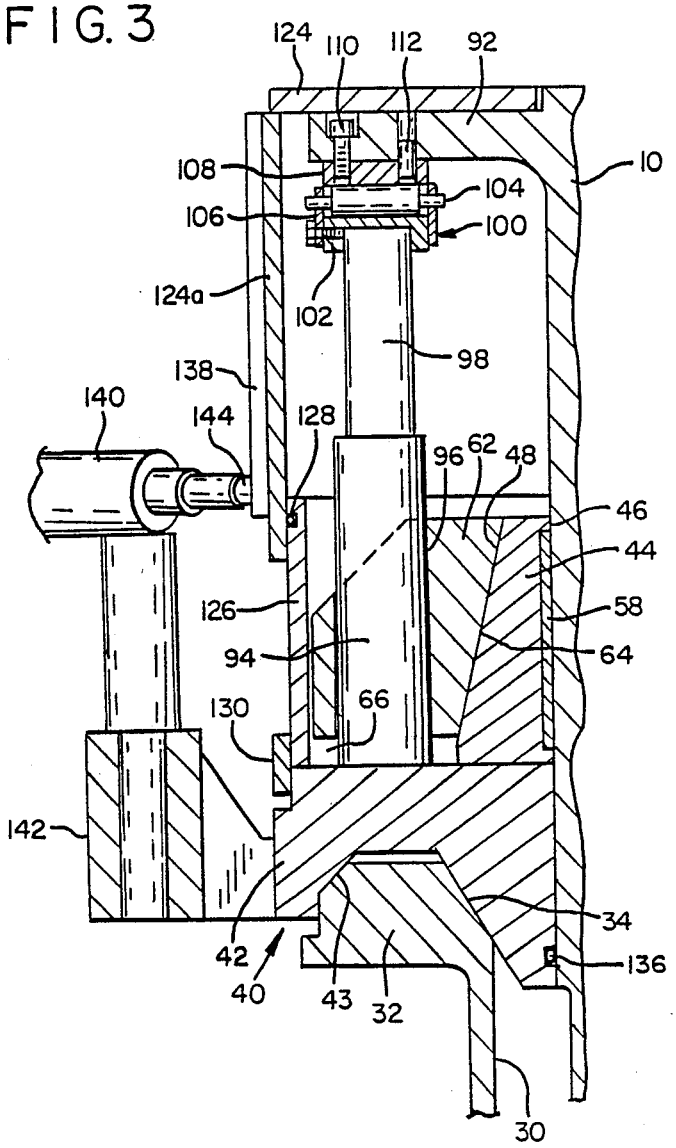
FIG. 3 is a fragmentary vertical sectional view taken on the line 3—3 of FIG. 2.
Figure 1:
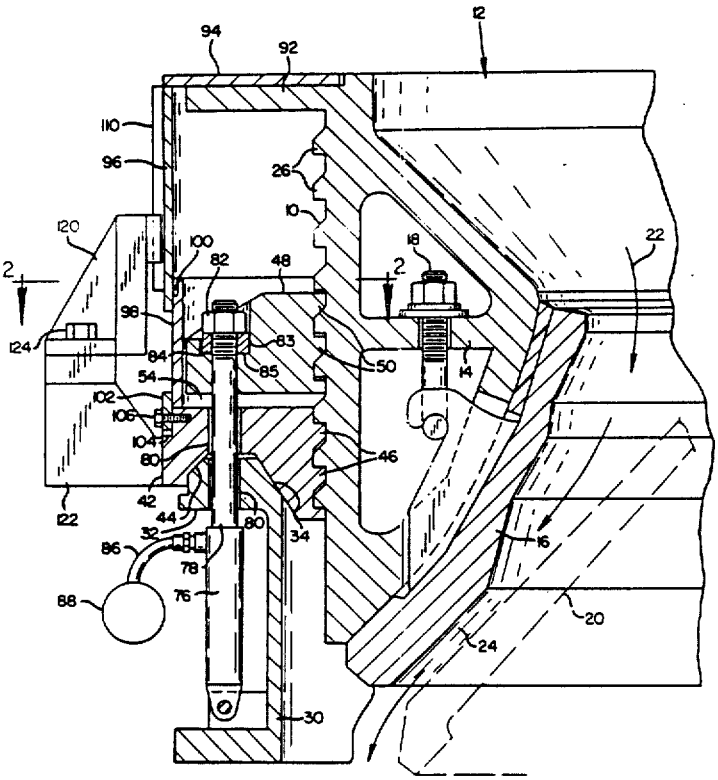
Figure 2:
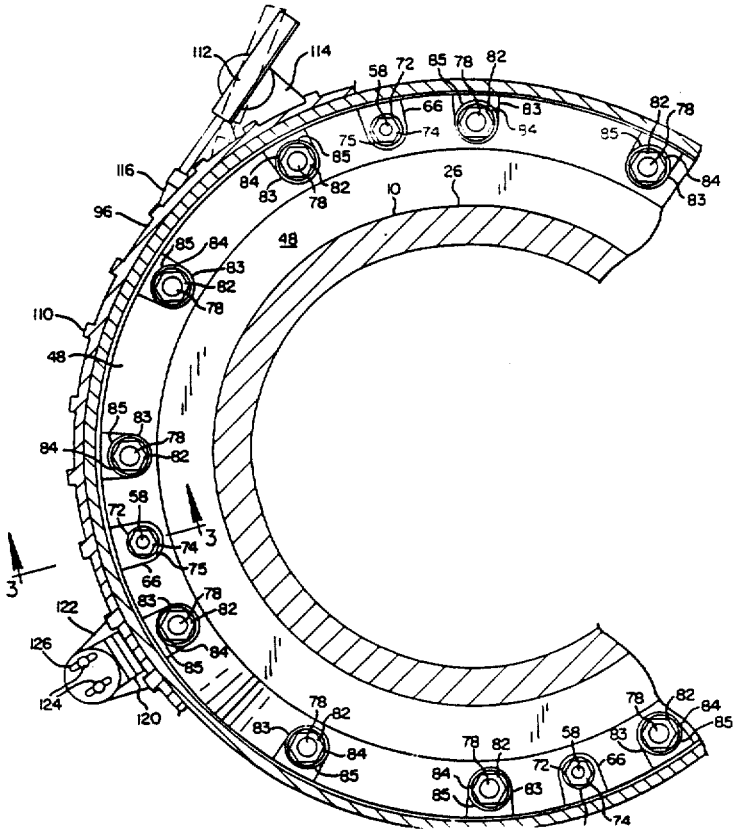
Figure 3:
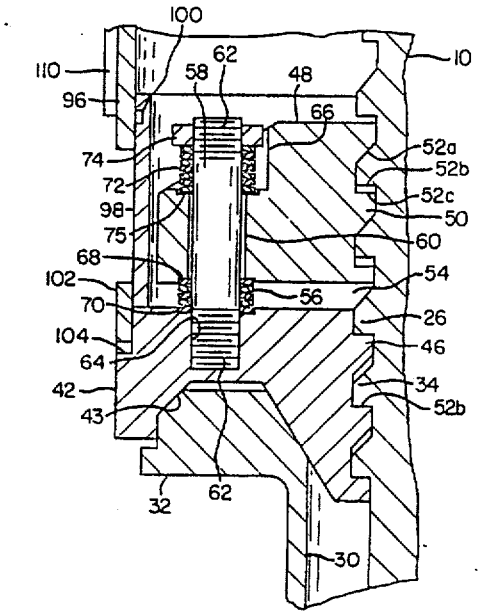
Figure 4:
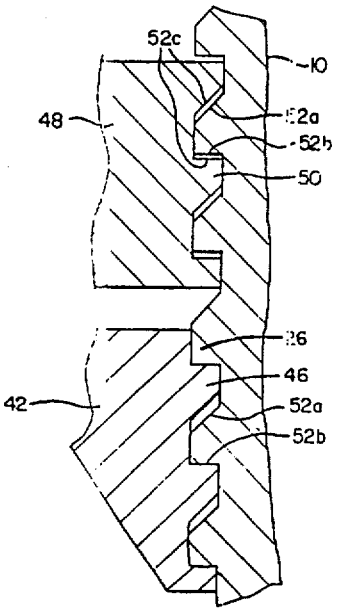
Figure 5:
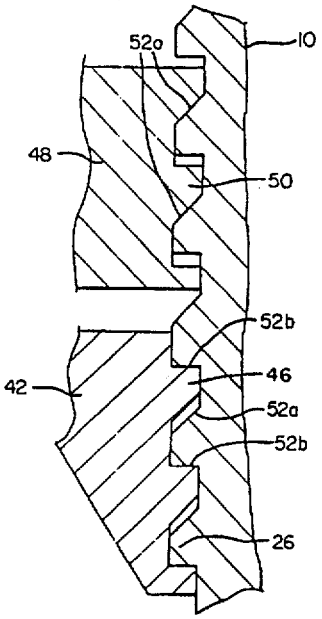

With particular reference to FIG. 3, the locking ring 48 is supported vertically above the support ring 42 and maintained to a clearance 54 therebetween by a plurality of disc springs 56 seated on bowl support ring 42. The clearance 54 provides a proper working space of the locking ring 48 above the bowl support ring 42, as will be more apparent hereinafter.

Locking ring 48 is guided vertically by a plurality of retainer pins 58 on which the disc springs 56 are confined. The retainer pins 58 extend vertically through bores 60 in locking ring 48 and have threads 62 at each end. The lower end threads of the pins have threaded engagement in tapped bores 64 in bowl support ring 42. The upper ends of the retainer pins extend into and are confined in recesses 66 in the upper surface of the locking ring. Bores 60 are enlarged slightly relative to the diameter of the retainer pins 58 to provide free movement of the pins relative to the locking ring. These retainer pins, which may be of any suitable number, such as 12, provide correct placement and location of the locking ring 48 relative to the bowl support ring 42.

In a preferred structure and as shown in FIG. 3, the disc springs 56 are confined between a recess 68 in the bottom of locking ring 48 and a recess 70 in the top of bowl support ring 42. Disc springs 72 are also provided between locking nuts 74 on the upper threaded end of retainer pins 58 and a recess 75 in the upper surface of locking ring 48.

With reference to FIG. 1, a plurality of hydraulic cylinders 76, for example twelve in number, are pivotally secured at their lower ends to the crusher frame 30 and have their rod portions 78 projecting freely upwardly through bores 80 in the base flange 32 and bowl support ring 42.

These rod portions 78 also project through the locking ring 48 and have their cylinder rod nut 82 disposed and confined in recesses 83 in the upper surface of the locking ring 48. As apparent in the drawings, the rod portions 78 and the rod nuts 82 thereof have a free or clearance fit with the confining portions thereof to allow slight radial movement during operation. Additional free movement in an angular direction is provided by spherical washers 84 on the rods 78 seated in countersunk recesses 85.

Hydraulic cylinders 76 are designed for powered functioning in a downward direction and thus are capable of forcefully pulling the locking ring 48 downwardly. A downward thrust on the ring 48 provides a clamping engagement circumferentially of the bowl on the bowl support ring 42, as will be more apparent hereinafter. The hydraulic cylinders 76 also provide, through the medium of the locking ring 48 and bowl 10, a hold down function of the bowl support ring 42 relative to the main frame flange 32.

Cylinders 76 can be connected together in one common fluid system 86 or can be connected in banks of two or more around the crusher, as is well known. Also, the fluid system of the cylinders is provided with one or more accumulators 88 which can be set at selected loads so as to provide relief and protection to the cylinders. Upon selected pressure setting of the accumulators, they will allow the bowl support ring 42 and the integrated bowl to lift off the base flange 32 and allow tramp material to pass through the crusher without damage to the internal mechanical parts.

Bowl 10 has an outwardly directed top flange 92 with a cap member 94 bolted or otherwise secured thereto. This cap member includes an integral downwardly extending peripheral wall 96 thereon and this wall has vertical overlapping engagement with an upstanding peripheral wall 98 seated on the bowl support ring 42. The overlapping portion of walls 96 and 98 include a dust seal 100, and such walls thus make for a sealed environment on the inner side thereof.

Wall 98 has an integral offset depending peripheral flange 102 extending over a peripheral notched portion 104 on the outer upper surface of the bowl support ring 42. This depending flange provides guided positioning of the upstanding peripheral wall 98 on the support ring 42. The upstanding peripheral wall 98 is restrained from moving upward whenever tramp material passes through the crusher by a plurality of capscrews 106 securing the flange 102 to the bowl support ring 42.

Suitable means are provided for adjusting the bowl assembly, best seen in FIGS. 1 and 2. A representative structure comprises a plurality of projections 110 on wall 96. These projections run the full height of wall 96 to compensate for downward adjustment of this wall and are arranged for engagement by two ratcheting hydraulic ram cylinders 112 secured to a bowl support boss 114 on support ring 42. When these ram cylinders are actuated, they drive the wall portion 96 therewith through the medium of the projections 110. This is shown diagrammatically in FIG. 2 by the ram cylinder fork 116 in retracted and extended positions. Since wall portion 96 is secured to the bowl top flange 92, the bowl is rotated when the ram cylinders 112 are operated.

It is preferred that the bowl have a safety lock means which will positively prevent relative rotation of the bowl on its support when crushing, and for this purpose, at least two right angle brackets 120, FIGS. 1 and 2, are bolted to lock bosses 122 on the bowl support ring 42 and are arranged to have locked positioning between pairs of the projections 110. Bolts 124 extend through elongated slots 126 in the brackets and provide movement between an inner locking position between a pair of the projections or an outer clearance position of the projections to allow the bowl to rotate.

OPERATE

Figure 4:
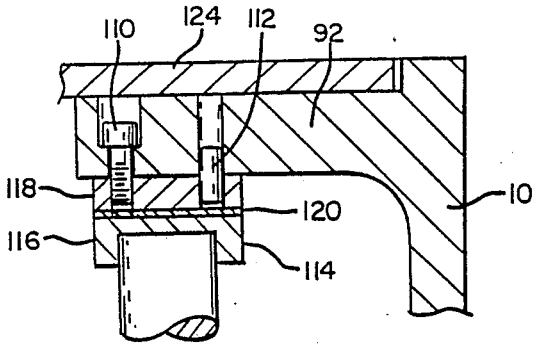
FIG. 4 is a fragmentary sectional view showing thread engagement of a locking ring in the released condition of the hold down means.

In the assembly of the present crusher, the locking ring 48 is positioned on the bowl such that it rests on disc springs 56. This forms the clearance area 54. Thereupon, the disc springs 72 are compressed by selected tightening of the locking nuts 74 to lower the locking ring 48 and reduce the clearance area 54 somewhat. This lowered position of the locking ring is shown in FIG. 4 wherein the mating surfaces of the threads 26 and 50 have a clearance **52*c* at the tapered areas 52*a* and at the flat areas 52*b* as well. Such comprises a substantially friction-free or floating association between the bowl and the locking ring. That is, the vertical and circumferential position of the locking ring relative to the bowl support ring is such that small clearance (for example 1/16") exists at 52*c*. This position is required when the hydraulic force created by the hydraulic cylinders 76** is removed and the bowl assembly is rotated to change the setting of the crusher. The thread form for accomplishing the above is that of the buttress type.

When it is desired to adjust the bowl rotatably, the pressure in the hydraulic cylinders 76 is released so as not to apply any downward force on the locking ring. In such released condition of the cylinders, the locking ring will assume its floating FIG. 4 position. Prior to rotation of the bowl, the bowl locking brackets 120 are backed off. Then the hydraulic ram cylinders 112 are powered to provide such powered rotation. In this rotation, the ram fork engages successive projections 110 on the wall 96. The only restraining force against rotation will be the friction of support of the bowl threads on the support ring threads, the locking ring threads being disengaged from the bowl at this time in their floating condition. The bowl threads and the support ring threads have engagement at the flat thread areas **52*b*** in all phases of operation.

Figure 5:
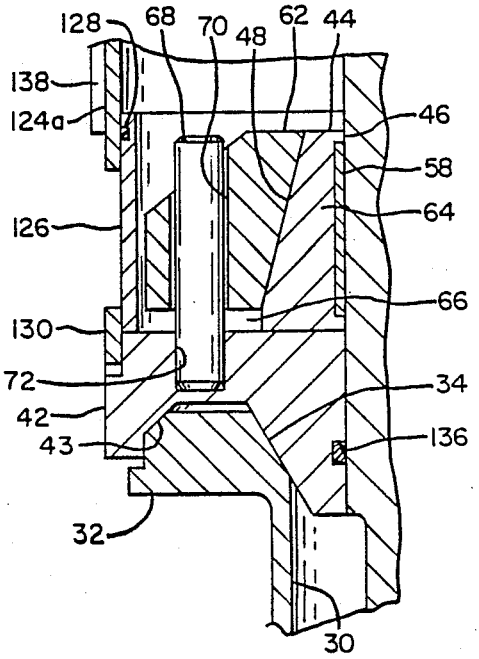
FIG. 5 is a fragmentary sectional view showing the condition of the threads when the hold down means are in operation.

When the proper adjustment of the bowl has been accomplished, pressure is applied to hold-down cylinders 76. Such hold-down pressure forces not only provide the hold-down function but also cause the locking ring 48 to impart frictional forces against the bowl sufficient to prevent rotation. The thread relationship of the locking ring 48 and bowl support ring 42 relative to the bowl threads during the application of clamping pressure by the cylinders 76 is shown in FIG. 5 wherein the tapered thread surfaces **52*a* associated with the locking ring and bowl threads are locked together, thereby providing the downward clamping forces of the flat thread areas 52***b* of the support ring and bowl threads. After the desired adjustment is accomplished, the bowl lock brackets 120 are set to serve as a backup to prevent any rotative creep of the bowl caused by unusual circumstances.

In the event that a piece of tramp material accidentally gets into the crusher, the accumulators 88 in the cylinder fluid system allow the bowl and bowl support ring 42 to tilt so that the tramp material can pass through without damaging the parts.

According to the invention, a gyratory rock crusher is provided that employs improved features which contribute to its simplification and improved operation. The structure positively stabilizes the bowl during crushing operation but allows for the convenient adjustment of the bowl. Also, a simplified structure is utilized wherein the force of the hold-down mechanism provides the holding force for the bowl support ring on the main frame. The structure allows most tramp material to efficiently pass through between the mantle and the bowl. The powered forces associated with locking, unlocking, hold-down, relief, and adjustment means are hydraulic and thus contribute to simplicity and efficiency in operation. The locking mechanism is concealed within the crusher and thus is not subjected to an undesirable environment. Also, the locking means is compact in height whereby to minimize vertical height, and in addition the locking, unlocking, relief, and hold-down are operated by the single source 76 and thus requires minimum hydraulic hoses and fittings.

It is to be understood that the form of my invention herein shown and described is to be taken as a preferred example of the same and that various changes in the shape, size and arrangement of parts may be resorted to without departing from the spirit of my invention or the scope of the subjoined claims. For example, although the operating parts herein are described as being hydraulic, any fluid drive would be workable.

Having thus described my invention, I claim:

1. A gyratory crusher comprising:

a main frame, a base member on said main frame having an annular inwardly directed threaded surface extending in an upright direction, a bowl having an outwardly directed threaded surface engageable with the threaded surface of said base member for supporting said bowl on said base member and for rotatably adjusting said bowl to different vertical planes, crushing means including a power driven mantle operative in association with said bowl for crushing material, non-rotatable bowl locking means above said threaded surface of said base member, said locking means having an inwardly directed threaded surface engageable with the threaded surface of said bowl, and hydraulic hold-down means secured to said main frame imparting a hold-down force on said locking means which in turn provides a hold-down force acting through the threads of said locking means and said bowl to maintain said bowl in a stationary vertical position relative to said mantle and also to frictionally lock the threads of said locking means and bowl together to maintain said bowl in a non-rotatable position.

2. The gyratory crusher of claim 1 wherein said locking means comprises an annular ring.

3. The gyratory rock crusher of claim 1 wherein said locking means comprises an annular ring, and a plurality of upright retainer pins extending between said base member and said locking ring to provide correct placement and location of said locking ring.

4. The gyratory crusher of claim 1 wherein said locking means comprises an annular ring, a plurality of upright retainer pins extending between said base member and said locking ring to provide correct placement and location of said locking ring, and spring disc means on said retainer pins between said locking ring and said base member for maintaining said locking ring in spaced relation from said base member.

5. The gyratory crusher of claim 1 wherein said locking means comprises an annular ring, a plurality of upright retainer pins extending between said base member and said locking ring to provide correct placement and location of said locking ring, spring disc means on said retainer pins between said locking ring and said base member for maintaining said locking ring in spaced relation from said base member, and adjustable thrust means on said retainer pins arranged to bear down on said locking ring for relieving the threads of said locking ring of downward engagement by the bowl threads.

6. The gyratory crusher of claim 1 wherein said hold-down means includes hydraulic relief means allowing tilting of said base member and bowl relative to the mantle in the event a foreign object gets in the crusher.

7. The gyratory crusher of claim 1 wherein said bowl has an upper outwardly extending flange, and vertically extending first and second wall means attached to said flange and to said base member, respectively, having overlapping slidable engagement in closing said locking means.

8. The gyratory crusher of claim 1 including hydraulically operated means mounted on said base member and arranged when actuated to rotate said bowl relative to said base member.

9. The gyratory crusher comprising:

a base member having an annular inwardly directed threaded surface extending in an upright direction, a bowl having an outwardly directed threaded surface engageable with the threaded surface of said base member for supporting said bowl on said base member and for rotatably adjusting said bowl to different vertical planes, crushing means including a power driven mantle operative in association with said bowl for crushing material, and hold-down means operative between said base member and the threads of said bowl to maintain said bowl in a stationary vertical position relative to said mantle and also to frictionally engage the threads of said bowl to maintain said bowl in a non-rotatable position.

10. The gyratory crusher of claim 9 wherein said hold-down means comprises a plurality of hydraulic cylinders.

* * * * *

UNITED STATES PATENT AND TRADEMARK OFFICE

CERTIFICATE OF CORRECTION

PATENT NO. : 4,923,129

DATED : May 8, 1990

INVENTOR(S) : Y. Jin Chae

It is certified that error appears in the above-identified patent and that said Letters Patent is hereby corrected as shown below:

The title page showing the illustrative figure should be deleted to be replaced with the attached title page.

The sheets of drawings consisting of figs. 1-5, should be added as shown on the attached page.

Signed and Sealed this

Seventh Day of July, 1992

*Attest:*

DOUGLAS B. COMER

*Attesting Officer*

*Acting Commissioner of Patents and Trademarks*

United States Patent [19]

Chae

[11] Patent Number: 4,923,129

[45] Date of Patent: May 8, 1990

[54] GYRATORY ROCK CRUSHER

[76] Inventor: Y. Jin Chae, 520 Main St., Fort Lee, N.J. 07024

[21] Appl. No.: 343,083

[22] Filed: Apr. 25, 1989

[51] Int. Cl.[5] ..... B02C 2/04

[52] U.S. Cl. ..... 241/207; 241/286

[58] Field of Search ..... 241/207, 208, 210, 211, 241/215, 216, 286, 290

[56] References Cited

U.S. PATENT DOCUMENTS

| | | | |
|---|---|---|---|
| 3,140,835 | 7/1964 | Balmer et al. | 241/286 |
| 3,690,573 | 9/1972 | Kueneman et al. | 241/207 |
| 3,759,453 | 9/1973 | Johnson | 241/207 |
| 4,478,373 | 10/1984 | Gieschen | 241/208 |
| 4,697,745 | 10/1987 | Sawant et al. | 241/207 X |

*Primary Examiner*—Timothy V. Eley
*Attorney, Agent, or Firm*—Eugene M. Eckelman

[57] ABSTRACT

A bowl support ring for a gyratory rock crusher has an annular inwardly directed threaded surface extending in an upright direction. A bowl having an outwardly directed threaded surface is engageable with the threaded surface on the bowl support ring for supporting the bowl on the support ring and for rotatably adjusting it to different vertical planes. A locking ring threadedly engaged with the bowl above the support ring is connected to downwardly extending hydraulic cylinders secured to the main frame of the crusher. These cylinders are arranged to apply a hold-down force on the locking ring which in turn provides a hold-down force acting through the threads of the locking ring and bowl to maintain the bowl in a stationary vertical position and also to frictionally lock the threads of the locking ring and bowl together to maintain the bowl in a non-rotatable position. A plurality of retainer pins with adjustable thrust portions maintain the locking ring in proper spaced relation from the support ring.

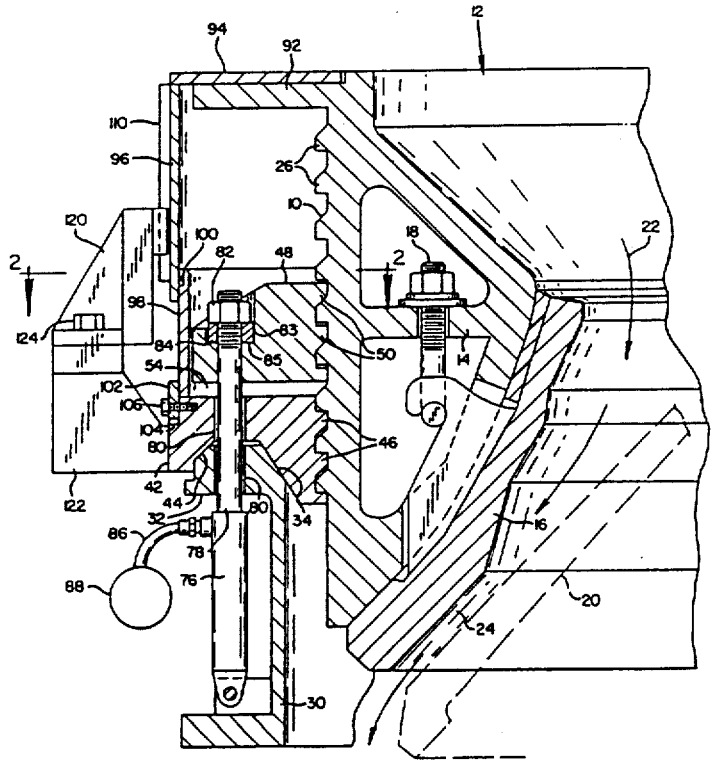

10 Claims, 3 Drawing Sheets